US006149737A

United States Patent [19]

Hattori et al.

[11] Patent Number: 6,149,737

[45] Date of Patent: Nov. 21, 2000

[54] HIGH STRENGTH HIGH-TOUGHNESS ALUMINUM ALLOY AND METHOD OF PREPARING THE SAME

[75] Inventors: Hisao Hattori; Toshihiko Kaji; Manabu Hashikura; Yoshishige Takano, all of Itami, Japan

[73] Assignees: Sumitomo Electric Industries Ltd., Osaka; Japan Science and Technology Corporation, Kawaguchi, both of Japan

[21] Appl. No.: 09/068,423

[22] PCT Filed: Sep. 5, 1997

[86] PCT No.: PCT/JP97/03127

§ 371 Date: May 8, 1998

§ 102(e) Date: May 8, 1998

[87] PCT Pub. No.: WO98/10108

PCT Pub. Date: Mar. 12, 1998

[30] Foreign Application Priority Data

Sep. 9, 1996 [JP] Japan ..... 8-237597

[51] Int. Cl.[7] ..... C22C 21/00

[52] U.S. Cl. ..... 148/403; 148/437; 148/438; 148/549

[58] Field of Search ..... 148/437, 438, 148/549, 403

[56] References Cited

U.S. PATENT DOCUMENTS

| | | | |
|---|---|---|---|
| 5,318,641 | 6/1994 | Masumoto et al. | 148/403 |
| 5,332,456 | 7/1994 | Masumoto et al. . | |
| 5,431,751 | 7/1995 | Okochi et al. . | |
| 5,532,069 | 7/1996 | Masumoto et al. . | |

FOREIGN PATENT DOCUMENTS

| | | |
|---|---|---|
| 0445684 | 9/1991 | European Pat. Off. . |
| 0475101 | 3/1992 | European Pat. Off. . |
| 0534155 | 3/1993 | European Pat. Off. . |
| 0540056 | 5/1993 | European Pat. Off. . |
| 0558977 | 9/1993 | European Pat. Off. . |
| 0584596 | 3/1994 | European Pat. Off. . |
| 0675209 | 10/1995 | European Pat. Off. . |
| 0693567 | 1/1996 | European Pat. Off. . |
| 56-065953 | 6/1981 | Japan . |
| 58-064363 | 4/1983 | Japan . |
| 01152248 | 6/1989 | Japan . |
| 01275732 | 11/1989 | Japan . |
| 03036243 | 2/1991 | Japan . |
| 04041654 | 2/1992 | Japan . |
| 05001346 | 1/1993 | Japan . |
| 05125473 | 5/1993 | Japan . |
| 05125474 | 5/1993 | Japan . |
| 05125499 | 5/1993 | Japan . |
| 05140685 | 6/1993 | Japan . |
| 05179387 | 7/1993 | Japan . |
| 05222478 | 8/1993 | Japan . |
| 05279767 | 10/1993 | Japan . |
| 05345944 | 12/1993 | Japan . |
| 06017178 | 1/1994 | Japan . |
| 06093393 | 4/1994 | Japan . |
| 06184712 | 7/1994 | Japan . |
| 06235040 | 8/1994 | Japan . |
| 06316738 | 11/1994 | Japan . |
| 07179974 | 7/1995 | Japan . |
| 07188823 | 7/1995 | Japan . |
| 07268528 | 10/1995 | Japan . |

*Primary Examiner*—John Sheehan
*Assistant Examiner*—Tima McGuthry-Banks
*Attorney, Agent, or Firm*—W. F. Fasse; W. G. Fasse

[57] ABSTRACT

An aluminum alloy is industrially producible and has higher strength and toughness than the prior art alloys. The high-strength high-toughness aluminum alloy includes a first phase of α-aluminum consisting of crystal grains whose mean crystal grain size is within the range of 60 to 1000 nm and a second phase of at least two different of intermetallic compounds consisting of crystal grains whose mean crystal grain sizes are within the range of 20 to 2000 nm. The crystal grains of the intermetallic compounds are dispersed so that they are only intermittently, and not continuously, linked throughout the alloy material.

13 Claims, 2 Drawing Sheets

HIGH STRENGTH HIGH-TOUGHNESS ALUMINUM ALLOY AND METHOD OF PREPARING THE SAME

TECHNICAL FIELD

The present invention relates to an aluminum alloy, which is applicable to a part or a structural material to requiring toughness, and which has high strength and excellent toughness, and a method of preparing the same.

BACKGROUND ART

Many studies have heretofore been carried out with regard to aluminum alloys of high strength with starting materials of alloys containing amorphous phases or quasi-crystal phases.

According to the technique disclosed in Japanese Patent Laying-Open No. 1-275732, for example, an amorphous substance or a complex of amorphous and microcrystalline substances having tensile strength of 87 to 103 kg/mm$^2$ and yield strength of 82 to 96 kg/mm$^2$ is obtained by rapidly solidifying a ternary alloy consisting of a general formula: $Al_aM_bX_c$ (where M: at least one or two metallic elements selected from V, Cr, Mn, Fe, Co, Ni, Cu, Zr, Ti, Mo, W, Ca, Li, Mg and Si, X: at least one or two metallic elements selected from Y, La, Ce, Sm, Nd, Hf, Nb, Ta and Mm (misch metal), a: 50 to 95 at. %, b: 0.5 to 35 at. % and c: 0.5 to 25 at. %.

An amorphous or microcrystalline high-strength aluminum alloy of low specific gravity and high strength is disclosed in Japanese Patent Laying-Open No. 6-316738. The aluminum alloy is expressed in a general formula: $Al_aX_bMm_c$ (Mm: misch metal), where X is at least one or two elements selected from Ti, V, Cr, Mn, Fe, Co, Ni, Cu and Zr, a, b and c are atomic %, a: 95.2 to 97.5 at. %, and b and c are values satisfying $2.5<b+c<5$ and $b>0.5$ and $c>1$. Due to having such a composition, there is obtained an aluminum alloy of low specific gravity and high strength in which an amorphous phase or a microcrystal phase is properly homogeneously dispersed in a microcrystal phase of a matrix while suppressing the amount of addition of alloy elements and the microcrystal phase of the matrix is solution-strengthened with Mm and the transition metal such as Ti, V, Cr, Mn, Fe, Co, Ni, Cu or Zr.

As hereinabove described, an amorphous alloy or an alloy consisting of a complex of amorphous and microcrystalline substances, or a microcrystalline alloy having a matrix of Al has tensile strength at least twice that of a conventional aluminum crystalline alloy. However, the Charpy impact value of the aforementioned aluminum alloy is so low that it does not even reach about ⅕ of that of a conventional aluminum ingot material. Thus, there has been such a problem that it is difficult to use the aluminum alloy as the material for a mechanical part or an automobile part which requires reliability.

Japanese Patent Laying-Open No. 6-184712, on the other hand, discloses a method of preparing a high-strength aluminum alloy. The aluminum alloy is expressed in a general formula: $Al_aLn_bM_c$, where Ln in the formula is at least one metallic element selected from Mm (misch metal), Y, La, Ce, Sm, Nd, Hf, Nb and Ta, M is at least one metallic element selected from V, Cr, Mn, Fe, Co, Ni, Cu, Zr, Ti, Mo, W, Ca, Li, Mg and Si, a: 50 to 97.5 at. %, b: 0.5 to 30 at. % and c: 0.5 to 30 at. %. The above mentioned Laying-Open Publication also discloses a preparation method that involves performing plastic working on a rapidly solidified aluminum alloy having such a composition and such a cellular diploid structure whereby an amorphous phase of 5 to 50 volume % encloses a microcrystal phase at a temperature exceeding the amorphous crystallization temperature, and obtaining such a structure in which an intermetallic compound consisting of at least two of the aforementioned Al, Ln and M is dispersed in a microcrystal matrix. In such an aluminum alloy, relatively high toughness is obtained such that the tensile strength is 760 to 890 MPa and elongation is 6.0 to 9.0%.

In the preparation method of the aluminum alloy disclosed in the aforementioned gazette, however, it requires a high cooling rate at the time of rapid solidification for obtaining the amorphous phase of 5 to 50 volume %, and hence there is such a problem that the preparation cost increases in actual industrial production.

In Japanese Patent Laying-Open No. 7-179974, further, an aluminum alloy comprising high strength and high toughness is disclosed. The dispersion-strengthened aluminum alloy has a complex structure including a matrix of α-aluminum and a precipitation phase of an intermetallic compound with a volume ratio of not more than 35 volume % of the intermetallic compound. The aluminum alloy is particularly characterized in that the aspect ratio of the precipitation phase of the intermetallic compound is not more than 3.0, the ratio of the crystal grain size of the α-aluminum to the grain size of the precipitation phase of the intermetallic compound is at least 2.0, and the crystal grain size of the α-aluminum is not more than 200 nm. In the aforementioned gazette, further, it is disclosed that the aluminum alloy having the aforementioned limited structure is obtained by performing a first heating treatment and a second heating treatment on gas-atomized powder containing an amorphous phase by at least 10 volume % or a green compact thereof and thereafter performing hot plastic working.

Also in the preparation method of the aluminum alloy disclosed in the aforementioned Laying-Open Publication, it still requires a high cooling rate at the time of rapid solidification for obtaining the amorphous phase of 10 volume %, and hence there is such a problem that the preparation cost therefor increases in actual industrial production.

The problems of the aforementioned conventional techniques are summarized in the following Table 1.

TABLE 1

| | Alloy Structure | Problem |
|---|---|---|
| Japanese Patent Laying-Open No. 1-275732 | amorphous substance or complex of amorphous and microcrystalline substances | low toughness |
| Japanese Patent Laying-Open No. 6-316738 | microcrystal or microcrystal with amorphous substance dispersed therein | low toughness |
| Japanese Patent Laying-Open No. 6-184712 | microcrystal with intermetallic compound dispersed therein | requirement for high quenching degree |
| Japanese Patent Laying-Open No. 7-179974 | microcrystal with intermetallic compound dispersed therein | requirement for high quenching degree |

SUMMARY OF THE INVENTION

Accordingly, an object of the present invention is to solve the aforementioned problems and provide an industrially producible aluminum alloy having both strength and toughness higher than has been achieved in the prior art and a method of preparing the same.

In order to overcome the aforementioned problems, the inventors of this application have conducted a thorough evaluation and study as to submicron level microstructures of aluminum alloys and mechanical properties thereof. On that occasion, they have regarded the aluminum alloys as composite materials of α-aluminum crystals and intermetallic compounds of Al-added elements, and evaluated the same as grain dispersion-strengthened composite materials by returning to the relations between the material structures and the mechanical properties thereof. Consequently, the following matters have been proved.

Assume that consideration is given to a grain dispersion-strengthened composite material consisting of a matrix of a ductile material and grains of a brittle material. It is assumed that the aspect ratio of the grains of the brittle material is close to 1 on that occasion. When the grains of the brittle material are gradually added at random locations within a matrix of the ductile material originally being 100% ductile material, the spaces between the grains of the brittle material which have been from one another at first, gradually become narrower, so that clusters in which a plurality of grains of the brittle material are linked with each other occur in places. Further, when the number or proportion of the grains of the brittle material are so increased that the volume ratio thereof exceeds 30 to 40%, the grains of the brittle material come into contact and are linked with each other throughout the sample. If the volume ratio of the grains of the brittle material is less than 30%, the toughness of the composite material loosely reduces with an increase of the brittle material grains. When the volume ratio of the grains of the brittle material exceeds 30 to 40%, however, the toughness remarkably diminishes.

When the aspect ratio of the grains of the ductile material is sufficiently larger than 1 and the grains of the brittle material exist at random positions toward random directions, for example, the grains of the brittle material are linked with each other throughout the sample even in places where the volume ratio of the grains of the brittle material is lower than 30%, and there is a reduction of the critical volume ratio at which a toughness reduction occurs. Even if the volume ratio of the grains of the brittle material is higher than 40% to the contrary, it can happen that the linkage between the grains of the brittle material does not extend througout the sample and the toughness may be maintained when the grains of the brittle material are in a regular arrangement.

As hereinabove described, the toughness of the grain dispersion-strengthened composite material is not evenly regulated by only the volume ratio of the strengthening grains (the grains of the brittle material here) as having been considered in general, but to be regulated by the linkage between the strengthening grains.

When such recognition is applied to an aluminum alloy of an Al—TM—Ln (TM: transition metallic element, Ln: rare earth element) system or the like, an α-aluminum crystal can be regarded as the matrix of the ductile material, crystal grains of an intermetallic compound or fine amorphous regions can be regarded as the grains of the brittle material, and the aforementioned relation as to the volume ratio of the grains of the brittle material can be applied. When the aforementioned recognition is thus applied, it is necessary that the crystal grains of the intermetallic compound are not linked with each other throughout the sample, in order to obtain sufficient toughness.

On the basis of the aforementioned recognition, a high-strength high-toughness aluminum alloy according to the present invention is characterized in that it comprises a phase of α-aluminum consisting of crystal grains whose mean crystal grain size is within the range of 60 to 1000 nm and phases of at least two types of intermetallic compounds consisting of crystal grains whose mean crystal grain sizes are within the range of 20 to 2000 nm and the crystal grains of the intermetallic compounds are so dispersed that linkage between the crystal grains of the intermetallic compounds are intermittent, i.e., finely dispersed without being linked with each other continuously throughout the aluminum alloy.

The reasons for the limitation of the mean crystal grain size of the α-aluminum and the mean crystal grain sizes of the intermetallic compounds are described below.

If the mean crystal grain size of the α-aluminum is less than 60 nm, it requires a high cooling rate in preparation of the aluminum alloy and the preparation cost increases. If the mean crystal grain size of the α-aluminum is larger than 1000 nm, on the other hand, strengthening by refinement of the crystal grains is not effectively achieved but on the contrary the strength is reduced. For such reasons, the range of the mean crystal grain size of the α-aluminum is limited.

If the mean crystal grain sizes of the intermetallic compounds are less than 20 nm, it requires a high cooling rate in preparation of the aluminum alloy, and the preparation cost increases. If the mean crystal grain sizes of the intermetallic compounds are larger than 2000 nm, on the other hand, composition strengthening action between the same and the matrix does not effectively takes place but on the contrary the strength is reduced. The range of the mean crystal grain sizes of the intermetallic compounds is limited for such a reason.

A preferable aluminum alloy of the present invention is characterized in that it contains a first intermetallic compound consisting of crystal grains whose crystal grain sizes are 20 to 900 nm in the interior of the crystal grains of the α-aluminum, and at least one type of second intermetallic compound of a type different from the first intermetallic compound, consisting of crystal grains whose crystal grain sizes are 400 to 2000 nm, is dispersed along the crystal grain boundaries of the α-aluminum, in addition to the aforementioned characteristics.

As hereinabove described, it is possible to suppress grain growth of the α-aluminum crystal under a high temperature for improving heat resistance by the geometrical configuration of the first and second intermetallic compounds, i.e., at least two types of intermetallic compounds.

In the preferable aluminum alloy of the present invention, further, the first intermetallic compound existing in the interior of the crystal grains of the α-aluminum contains Al and Zr, and the second intermetallic compound distributed along the crystal grain boundary or boundaries of the α-aluminum contains Al and Z (Z is at least one metallic element selected from the group consisting of Y, La, Ce, Sm, Nd and Mm (misch metal)).

The first intermetallic compound existing in the α-aluminum crystal grains thus contains Al and Zr, whereby the heat resistance can be improved due to the fact that diffusion of Zr in the aluminum matrix is slow. Due to the fact that the second intermetallic compound distributed along the α-aluminum crystal grain boundary contains Al and Z (Z is at least one metallic element selected from the group consisting of Y, La, Ce, Sm, Nd and Mm (misch metal)), further, the dispersiveness of the second intermetallic compound in the crystal grain boundary improves so that the toughness of the aluminum alloy can be improved.

Preferably, the first intermetallic compound existing in the α-aluminum crystal grains has an $L1_2$ type or $D0_{23}$ type crystal structure. Due to the fact that the first intermetallic compound is of the $L1_2$ type, matching of the grating or crystal lattic with the α-aluminum crystal improves and the heat resistance can be improved. If the first intermetallic compound is of the $D0_{23}$ type, on the other hand, an intermetallic compound excellent in stability of the crystal structure can be obtained.

Further preferably, the shape of the second intermetallic compound distributed along the α-aluminum crystal grain boundary has a limited shape as described below, on a ground section of the aluminum alloy of the present invention:

It is preferable that the mean value of the peripheral length of the second intermetallic compound is 7 to 15 μm, the mean value of the roundness of the second intermetallic compound is 0.15 to 0.45, the mean value of the acicular ratio of the second intermetallic compound is 1 to 5, the standard deviation of the second intermetallic compound in the major axis direction is at least 40°, and the volume ratio of the second intermetallic compound is 12 to 25%. The second intermetallic compound can effectively exhibit a grain boundary pinning effect for the α-aluminum crystal for improving the heat resistance with no linkage by distributing the grains of the second intermetallic compound having the shape thus limited along the α-aluminum crystal grain boundary.

In the aforementioned limitation related to the shape of the intermetallic compound, the roundness is defined as 4×π×(sectional area of intermetallic compound)/(peripheral length of section of intermetallic compound)$^2$. The acicular ratio is defined as a2/a1=(absolute maximum length of section of intermetallic compound)/(absolute maximum width of section of intermetallic compound perpendicular to absolute maximum length a2, i.e. distance between two straight lines that are parallel to the absolute maximum length a2and that embrace the outer periphery of the section of the intermetallic compound therebetween) on a section of an intermetallic compound as shown in FIG. 1. Further, the standard deviation of the intermetallic compound in the major axis direction is expressed in dispersion of an angle θ formed between an X-axis and the direction of the major axis of an intermetallic compound grain expressed by a dotted line on a section of the intermetallic compound shown in FIG. 2, i.e., the standard deviation of the respective angle θ of the intermetallic compound grains.

Preferably, the composition of the aluminum alloy of the present invention is expressed in a general formula: $Al_aZr_bX_cZ_d$. Here, X is at least one metallic element selected from the group consisting of Ti, V, Cr, Mn, Fe, Co, Ni and Cu, Z is at least one metallic element selected from the group consisting of Y, La, Ce, Sm, Nd and Mm (misch metal), a is within the range of 90 to 97 at. %, b is within the range of 0.5 to 4 at. %, and c and d are atomic % within the range enclosed with points A, B, C and D in FIG. 3. FIG. 3 shows the atomic % of the metallic element X on the horizontal axis and the atomic % of the metallic element Z on the vertical axis, the coordinates are expressed in sets of the atomic % of the metallic element X and the atomic % of the metallic element Z, the coordinates of the point A are (0.1, 4), the coordinates of the point B are (0.1, 1), the coordinates of the point C are (2.5, 1), and the coordinates of the point D are (1.5, 3). The values of the atomic % of c and d have values within a region enclosed by border lines defined between the points A and B, B and C, C and D, and D and A, respectively, as 3.

The reasons why the roles of the elements added to the aluminum alloy and the contents thereof are limited as described above are now described.

Al forms a homogeneous and fine structure as an α-aluminum crystal, and contributes to improvement of the strength due to a crystal grain refinement effect.

Zr becomes a crystal nucleus of α-aluminum crystallization as $A1_3Zr$ in rapid solidification. Homogeneous fine dispersion of α-aluminum crystal grains becomes possible by homogeneous dispersion of this crystal nuclei in a sample. It is necessary that the content of Zr is in the range of 0.5 to 4 atomic %. The effect of becoming a crystal nucleus is not sufficient if the content of Zr is less than 0.5 atomic %. If the content of Zr is larger than 4 atomic %, on the other hand, the volume ratio of $Al_3Zr$ as an intermetallic compound becomes too large and the toughness reduces. The content of Zr is limited for such reasons.

X (at least one metallic element selected from the group consisting of Ti, V, Cr, Mn, Fe, Co, Ni and Cu) increases the viscosity of an alloy melt, and increases the number density of the crystal nuclei of α-aluminum crystallization. The effect of increasing the number density of the crystal nuclei is not sufficient if the content of the metallic element X is less than 0.1 atomic %. If the content of the metallic element X is larger than 2.5 atomic %, on the other hand, the volume ratio of Al—X as an intermetallic compound becomes too large and the toughness reduces. The range of the content of the metallic element X is limited for such reasons.

Z (at least one metallic element selected from Y, La, Ce, Sm, Nd and Mm (misch metal)) increases the viscosity of the alloy melt, and increases the number density of the crystal nuclei for α-aluminum crystallization. Further, the metallic element Z is dispersed and precipitated along the grain boundary of the α-aluminum crystal grains in crystallization as the intermetallic compound with Al, and contributes to strength improvement by dispersion strengthening. If the content of the metallic element Z is less than 1 atomic %, the effect of increasing the number density of the crystal nucleus is not sufficient. If the content of the metallic element Z is larger than 4 atomic %, on the other hand, the volume ratio of Al—X as the intermetallic compound becomes too large and the toughness reduces. The range of the content of the metallic element Z is limited for such reasons.

The aluminum alloy of the present invention can be obtained by rapidly solidifying a melt of an alloy consisting of Al and at least two types of added elements which are strong in affinity for Al and mutually weak in affinity for each other by a liquid quenching method and performing a heat treatment thereon as needed. It is particularly preferable that the cooling rate in this case is $10^3$ to $10^5$K/sec.

According to a method of preparing an aluminum alloy according to the present invention, further, a high-strength high-toughness aluminum alloy limited as described above is obtained by heat-treating a rapidly solidified aluminum alloy having a cellular diploid structure wherein an intermetallic compound phase having Al as one of its elements, which is different from a crystal nucleus, encloses an α-aluminum microcrystal phase with the crystal nucleus of an intermetallic compound having Al as one of its elements. The heat-treating is carried out to a temperature of at least 593K at a temperature rising rate of at least 1.5K/sec. The method thus employs the aforementioned rapidly solidified crystalline aluminum alloy as the starting material, whereby the starting material can be prepared at a lower cooling rate as compared with the prior art. Further, the intermetallic compound distributed along the α-aluminum crystal grain boundary, which has been linked in the stage of the starting material, is not linked, i.e. becomes unlinked, by heat-treating this starting material to the temperature of at least 593 K at the temperature rising rate of at least 1.5K/sec., and high toughness can be obtained as a result. If the heat treatment at this time is performed at a temperature of less than 593K, linkage of the intermetallic compound distributed along the α-aluminum crystal grain boundary cannot be cut or disrupted. If the heat treatment is performed at a temperature rising rate of less than 1.5K/sec., on the other hand, the α-aluminum crystal grains become coarse and the strength of the obtained alloy reduces as a result.

It is preferable that the rapid solidification at the time of preparing the aforementioned aluminum alloy as the starting material is performed by a gas atomizing method or a liquid atomizing method. Further, it is preferable to perform hot plastic working after the aforementioned heat treatment. In this case, it is preferable that the hot plastic working is performed by powder forging.

According to the present invention, as hereinabove described, it is possible to obtain an aluminum alloy having both high strength and toughness at a low cost by an industrially producible method.

BEST DETAILED DESCRIPTION OF THE MODE FOR CARRYING OUT THE INVENTION

Example A

Figure 1:
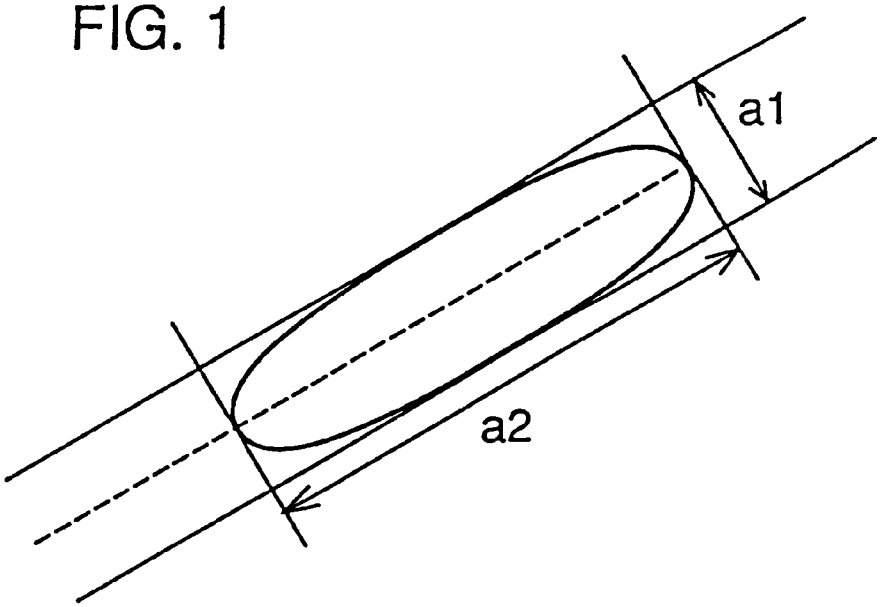
FIG. 1 is a diagram, employed for defining the acicular ratio of an intermetallic compound distributed along an α-aluminum crystal grain boundary in a preferable aluminum alloy according to the present invention, typically showing a section of the intermetallic compound.
Figure 2:
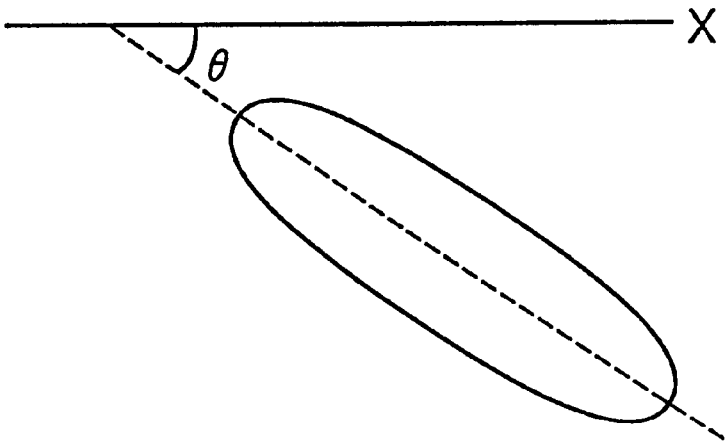
FIG. 2 is a diagram, employed for defining the standard deviation of the orientation of the intermetallic compound distributed along the α-aluminum grain boundary in the preferable aluminum alloy according to the present invention in the direction of the major axis, typically showing a section of the intermetallic compound.
Figure 3:
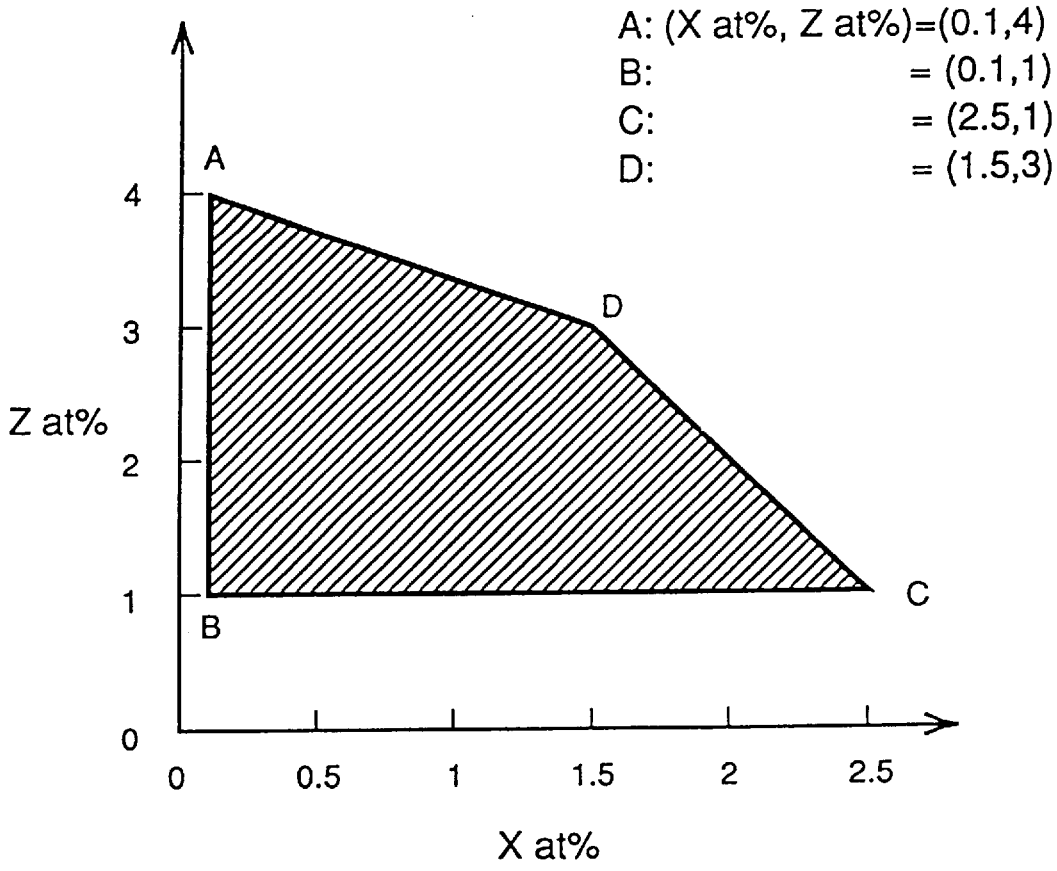
FIG. 3 is a diagram showing the composition range of metallic elements X and Z in the preferable aluminum alloy according to the present invention.

Aluminum alloys having alloy compositions shown in Table 2 were worked into ingots by arc melting, and thereafter these ingots were worked into ribbon-like samples with a single-roll type liquid quencher. In Table 2, the compositions of the respective alloys are shown in values of atomic % of the contained elements, and "Al—bal" indicates that the balance is aluminum. Preparation of the ribbon-like samples was performed by setting a quartz nozzle comprising 0.5 mm diameter pores on its forward end at a position 0.5 mm immediately above a copper roll rotating at 2000 rpm, high-frequency melting the ingot aluminum alloys introduced into the quartz nozzle and injecting melts of the aluminum alloys under an injection pressure of 78 kPa for carrying out ribbon formation.

Observing the structure of the ribbon-like sample thus obtained as to each Example, it was confirmed that the same has a cellular diploid structure wherein an intermetallic compound phase having Al as one of its elements, which is different from a crystal nucleus, encloses an α-aluminum crystal phase with the crystal nucleus of an intermetallic compound having Al as one of its elements.

Further, these ribbons were heat-treated under conditions in Table 2. In Table 2, e.g. "773K30sec" means that the sample was heat-treated at the temperature of 773K for 30 seconds. The temperature rising rate was at least 1.5 K/sec. in each heat treatment.

In order to confirm the cooling rate at the time of ribbon formation, a ribbon of a 2014 Al alloy composition was prepared under similar preparation conditions, and the actual cooling rate was estimated by measuring the dendrite arm space in its structure. According to this, the cooling rate was determined to be $3\times10^4$K/sec.

The microstructures were observed with a scanning electron microscope (SEM) of high resolution as to the obtained ribbons of respective Examples and respective comparative examples. According to the results of the observation, it was observed that intermetallic compounds (IMC) were finely dispersed without being linked with each other in the inventive Examples, as shown in Table 2. On the other hand, it was observed that intermetallic compounds were linked with each other in the comparative examples.

Further, a tensile test was performed using an Instron tensile tester on the ribbons obtained in respective Examples and respective inventive comparative examples. The results thereof are also shown in Table 2. UTS indicates the values of ultimate tensile strength. It is understood that each one of the inventive Examples has both high tensile strength and high elongation as compared with comparative examples.

TABLE 2

| Ribbon | Composition (atomic %) | Heat Treatment Condition | Observed First Intermetallic Compound | Observed Second Intermetallic Compound | Structure IMC Linked or Unlinked | UTS (MPa) | Elongation (%) |
|---|---|---|---|---|---|---|---|
| Example 1 | Al-bal Zr-2 Ti-1 Mm-2 | 773K 30 sec | $Al_3$(Zr, Ti) | $Al_{11}Mm_3$ | unlinked | 740 | 0.35 |
| Example 2 | Al-bal Zr-2 Ti-1 Ce-2 | 773K 30 sec | $Al_3$(Zr, Ti) | $Al_4Ce$ | unlinked | 720 | 0.31 |
| Example 3 | Al-bal Zr-4 Ti-0.5 Mm-2 | 773K 30 sec | $Al_3$(Zr, Ti) | $Al_{11}Mm_3$ | unlinked | 780 | 0.28 |
| Example 4 | Al-bal Zr-0.5 Ti-0.5 Mm-2 | 773K 30 sec | $Al_3$(Zr, Ti) | $Al_{11}Mm_3$ | unlinked | 690 | 0.38 |
| Example 5 | Al-bal Zr-0.5 Ti-1 V-0.5 Mm-2 | 773K 30 sec | $Al_3$(Zr, Ti) | $Al_{11}Mm_3$, $Al_{11}V$ | unlinked | 720 | 0.4 |
| Example 6 | Al-bal Zr-4 Cr-0.5 Mm-2 | 773K 30 sec | $Al_3Zr$ | $Al_{11}Mm_3$, $Al_7Cr$ | unlinked | 700 | 0.27 |
| Example 7 | Al-bal Zr-2 V-1 Mm-2 | 773K 30 sec | $Al_3Zr$ | $Al_{11}Mm_3$, $Al_{11}V$ | unlinked | 710 | 0.35 |
| Example 8 | Al-bal Zr-4 V-1 Mm-2 | 773K 30 sec | $Al_3Zr$ | $Al_{11}Mm_3$, $Al_{11}V$ | unlinked | 730 | 0.25 |
| Example 9 | Al-bal Zr-2 Ni-1 Mm-2 | 773K 30 sec | $Al_3Zr$ | $Al_{11}Mm_3$, $Al_3Ni$ | unlinked | 700 | 0.3 |
| Example 10 | Al-bal Zr-4 Ni-1 Mm-2 | 773K 30 sec | $Al_3Zr$ | $Al_{11}Mm_3$, $Al_3Ni$ | unlinked | 750 | 0.23 |
| Example 11 | Al-bal Zr-2 Mn-1 Mm-2 | 773K 30 sec | $Al_3Zr$ | $Al_{11}Mm_3$, $Al_6Mn$ | unlinked | 650 | 0.31 |
| Example 12 | Al-bal Zr-2 Fe-1 Mm-2 | 773K 30 sec | $Al_3Zr$ | $Al_{11}Mm_3$, $Al_3Fe$ | unlinked | 690 | 0.29 |

TABLE 2-continued

| Ribbon | Composition (atomic %) | Heat Treatment Condition | Observed First Intermetallic Compound | Observed Second Intermetallic Compound | Structure IMC Linked or Unlinked | UTS (MPa) | Elongation (%) |
|---|---|---|---|---|---|---|---|
| Example 13 | Al-bal Zr-2 Co-1 Mm-2 | 773K 30 sec | $Al_3Zr$ | $Al_{11}Mm_3$, $Al_9Co_2$ | unlinked | 700 | 0.3 |
| Example 14 | Al-bal Zr-2 Cu-1 Mm-2 | 773K 30 sec | $Al_3Zr$ | $Al_{11}Mm_3$, $Al_2Cu$ | unlinked | 640 | 0.31 |
| Example 15 | Al-bal Zr-4 Ti-1 Mn- Mm-2 | 773K 30 sec | $Al_3(Zr, Ti)$ | $Al_{11}Mm_3$, $Al_6Mn$ | unlinked | 700 | 0.32 |
| Example 16 | Al-bal Zr-2 Ti-1 Co-1 Mm-2 | 773K 30 sec | $Al_3(Zr, Ti)$ | $Al_{11}Mm_3$, $Al_9Co_2$ | unlinked | 660 | 0.29 |
| Example 17 | Al-bal Zr-2 Ti-1 Ni-0.5 Mm-2 | 773K 30 sec | $Al_3(Zr, Ti)$ | $Al_{11}Mm_3$, $Al_3Ni$ | unlinked | 690 | 0.33 |
| Example 18 | Al-bal Zr-2 Ti-1 Fe-0.5 Mm-2 | 773K 30 sec | $Al_3(Zr, Ti)$ | $Al_{11}Mm_3$, $Al_3Fe$ | unlinked | 700 | 0.32 |
| Example 19 | Al-bal Zr-4 Ti-1 V-0.5 Mm-2 | 773K 30 sec | $Al_3(Zr, Ti)$ | $Al_{11}Mm_3$, $Al_{11}V$ | unlinked | 750 | 0.35 |
| Example 20 | Al-bal Zr-2 Cr-0.1 V-0.5 Mm-2 | 773K 30 sec | $Al_3Zr$ | $Al_{11}Mm_3$, $Al_{11}V$, $Al_7Cr$ | unlinked | 710 | 0.34 |
| Comparative Example 21 | Al-bal Zr-2 Ti-1 Mm-2 | no heat treatment | $Al_3(Zr, Ti)$ | $Al_{11}Mm_3$ | linked | 700 | 0.02 |
| Comparative Example 22 | Al-bal Zr-6 Ti-1 Mm-2 | 773K 30 sec | $Al_3(Zr, Ti)$ | $Al_{11}Mm_3$ | linked | 760 | 0 |
| Comparative Example 23 | Al-bal Zr-2 Ti-4 Mm-2 | 773K 30 sec | $Al_3(Zr, Ti)$ | $Al_{11}Mm_3$ | linked | 680 | 0.01 |
| Comparative Example 24 | Al-bal Zr-2 Ti-1 Mm-5 | 773K 30 sec | $Al_3(Zr, Ti)$ | $Al_{11}Mm_3$ | linked | 650 | 0.01 |

Example B

Aluminum alloy powder materials having alloy compositions shown in Table 3 were prepared with a gas atomizer. Atomization was performed by pressurizing nitrogen gas to 10 kgf/cm$^2$ and colliding the same against droplets of melts of the aluminum alloys dropped from a nozzle whose hole diameter was 2 mm.

Observing the structure of the aluminum alloy powder thus obtained, it was confirmed that the same has a cellular diploid structure wherein an intermetallic compound phase having Al as one of its elements, which is different from the aforementioned crystal nucleus, encloses an α-aluminum crystal phase with the crystal nucleus of an intermetallic compound having Al as one of its elements, similarly to Example A.

Powder of the 2014 Al alloy composition was prepared under atomization conditions similar to the above, and the actual cooling rate was estimated from measurement of the dendrite arm space in its structure. According to this, the cooling rate was determined to be $2\times10^4$K/sec. when aluminum alloy powder whose grain size is 65 μm was obtained.

Then, each aluminum alloy powder prepared as described above was sieved to less than 65 μm, the treated powder was press-molded, thereafter a heating and degassing treatment was performed, and powder forging was performed at a temperature in the range of 593 to 873K. Ultimate temperatures and temperature rising rates of heating conditions for the respective press-molded bodies are shown in Table 3. The microstructures of the aluminum alloys of respective inventive Examples and respective comparative examples thus obtained were observed with an SEM of high resolution similarly to Example A. According to this, it was observed that intermetallic compounds (IMC) were finely dispersed without being linked with each other in each of the inventive Examples. In comparative examples, on the other hand, it was observed that intermetallic compounds were linked with each other.

Further, sections of the respective powder-forged bodies were mirror-ground and microstructural photographs were taken with an SEM of high resolution at 50,000 magnifications. Thereafter the respective photographs were loaded into a personal computer, for performing image analysis by the computer. The shapes of second intermetallic compounds distributed along α-aluminum crystal grain boundaries were measured by this analysis. Data related to the shapes of the intermetallic compounds shown in Table 4 show mean values of data measured in three fields.

In Table 4, direction standard deviation shows the standard deviation in the direction of the major axes of the intermetallic compounds.

The intermetallic compounds and α-aluminum are different in contrast on the microstructural photographs from each other, whereby it was possible to perform measurement of the shapes of the intermetallic compounds by making the computer recognize only the second intermetallic compounds distributed on the α-aluminum crystal grain boundaries. As to the volume ratio of the intermetallic compound, it is applicable that the area ratio on a section is equal to the volume ratio as such, assuming that spatial distribution of the intermetallic compound is completely isotropic. Data obtained by calculating area ratios and regarding the values as the volume ratios are shown in Table 4 here. The mean peripheral length is the mean value of the peripheral length of the respective crystal grains of the intermetallic compound. Mean roundness and mean acicular ratio have been defined above herein.

It is understood that the data related to the shape of the intermetallic compound prepared in the aforementioned manner is within the range defined in the present invention in each Example.

Further, a tensile test was performed with an Instron tensile tester similarly to Example A, for measuring the ultimate tensile strength (UTS) and elongation of each powder-forged body. The Charpy impact value of each powder-forged body was also measured. These results are also shown in Table 4.

As obvious from these data related to the mechanical properties too, it is understood that the powder-forged bodies according to the inventive Examples have both high tensile strength and elongation as compared with those of comparative examples, and Charpy impact values thereof are also high.

TABLE 3

| Powder-Forged Body | Composition (atomic %) | Compact Heating Condition: Ultimate Temperature | Compact Heating Condition: Temperature Rising Rate | Observed First Intermetallic Compound | Observed Second Intermetallic Compound | Structure: IMC Linked or Unlinked |
|---|---|---|---|---|---|---|
| Example 31 | Al-bal Zr-2 Ti-1 V-0.5 Mm-2 | 773 K., | 4 K./s | $Al_3(Zr, Ti)$ | $Al_{11}Mm_3$ | unlinked |
| Example 32 | Al-bal Zr-2 Ti-1 V-0.5 Mm-2 | 773 K., | 4 K./s | $Al_3(Zr, Ti)$ | $Al_4Ce$ | unlinked |
| Example 33 | Al-bal Zr-4 Ti-0.5 V-0.5 Mm-2 | 773 K., | 4 K./s | $Al_3(Zr, Ti)$ | $Al_{11}Mm_3$ | unlinked |
| Example 34 | Al-bal Zr-0.5 Ti-1.5 V-0.5 Mm-2 | 773 K., | 4 K./s | $Al_3(Zr, Ti)$ | $Al_{11}Mm_3$ | unlinked |
| Example 35 | Al-bal Zr-0.5 Ti-1 V-0.5 Mm-2 | 773 K., | 4 K./s | $Al_3(Zr, Ti)$ | $Al_{11}Mm_3,Al_{11}V$ | unlinked |
| Example 36 | Al-bal Zr-4 Cr-0.5 V-0.5 Mm-2 | 773 K., | 4 K./s | $Al_3Zr$ | $Al_{11}Mm_3,Al_7Cr$ | unlinked |
| Example 37 | Al-bal Zr-2 V-1 Mm-2 | 773 K., | 4 K./s | $Al_3Zr$ | $Al_{11}Mm_3,Al_{11}V$ | unlinked |
| Example 38 | Al-bal Zr-2 V-1 Mm-2 | 773 K., | 4 K./s | $Al_3Zr$ | $Al_{11}Mm_3,Al_{11}V$ | unlinked |
| Example 39 | Al-bal Zr-2 Ni-1 Mm-2 | 773 K., | 4 K./s | $Al_3Zr$ | $Al_{11}Mm_3,Al_3Ni$ | unlinked |
| Example 40 | Al-bal Zr-4 Ni-1 Mm-2 | 773 K., | 4 K./s | $Al_3Zr$ | $Al_{11}Mm_3,Al_3Ni$ | unlinked |
| Comparative Example 41 | Al-bal Zr-2 Ni-1 Mm-2 | 773 K., | 4 K./s | $Al_3Zr$ | $Al_{11}Mm_3,Al_3Ni$ | linked |
| Comparative Example 42 | Al-bal Zr-6 Ti-1 Mm-2 | 773 K., | 4 K./s | $Al_3(Zr, Ti)$ | $Al_{11}Mm_3$ | linked |
| Comparative Example 43 | Al-bal Zr-2 Ti-1 Mm-2 | 773 K., | 4 K./s | $Al_3(Zr, Ti)$ | $Al_{11}Mm_3$ | linked |
| Comparative Example 44 | Al-bal Zr-2 Ti-1 Mm-5 | 773 K., | 4 K./s | $Al_3(Zr, Ti)$ | $Al_{11}Mm_3$ | linked |

TABLE 4

| Powder-Forged Body | Mean Peripheral Length ($\mu$m) | Mean Roundness | Mean Acicular Ratio | Direction Standard Deviation | Volume Ratio (%) | UTS (MPa) | Elongation (%) | Charpy Impact Value (J) |
|---|---|---|---|---|---|---|---|---|
| Example 31 | 11 | 0.31 | 1.8 | 45 | 18 | 810 | 5.1 | 11 |
| Example 32 | 12 | 0.33 | 1.6 | 48 | 17 | 760 | 4.8 | 10 |
| Example 33 | 11 | 0.3 | 1.8 | 46 | 22 | 820 | 4.6 | 10 |
| Example 34 | 13 | 0.25 | 1.7 | 43 | 19 | 700 | 5.9 | 9 |
| Example 35 | 11 | 0.35 | 1.8 | 45 | 18 | 770 | 6.2 | 10 |
| Example 36 | 10 | 0.32 | 1.8 | 48 | 23 | 730 | 4.5 | 7 |
| Example 37 | 12 | 0.22 | 1.7 | 47 | 18 | 730 | 5.2 | 8 |
| Example 38 | 12 | 0.35 | 1.7 | 43 | 24 | 800 | 4.5 | 10 |
| Example 39 | 11 | 0.31 | 1.9 | 48 | 17 | 740 | 4.7 | 10 |
| Example 40 | 10 | 0.31 | 1.9 | 46 | 23 | 760 | 4.4 | 10 |
| Comparative Example 41 | 18 | 0.11 | 2.2 | 42 | 19 | 740 | 0.2 | 1 |
| Comparative Example 42 | 20 | 0.1 | 2.3 | 41 | 36 | 790 | 0.3 | 2 |
| Comparative Example 43 | 20 | 0.1 | 2.3 | 40 | 37 | 720 | 0.5 | 1 |
| Comparative Example 44 | 25 | 0.08 | 2.5 | 41 | 38 | 700 | 0.6 | 1 |

Examples disclosed above must be considered as being not restrictive but illustrative in all points. The scope of the present invention is defined not by the aforementioned Examples but by the appended claims and includes all variations and modifications within the meaning and the scope of equivalents of the claims.

What is claimed is:

1. A high-strength high-toughness aluminum alloy comprising a first phase of α-aluminum crystal grains having a mean crystal grain size within the range of 60 to 1000 nm and a second phase comprising first and second intermetallic compounds that respectively have respectively different compositions, wherein said first intermetallic compound consists of first crystal grains having crystal grain sizes in a range from 20 to 900 nm, said second intermetallic compound consists of second crystal grains having crystal grain sizes in a range from 400 to 2000 nm, said first crystal grains are present in interiors of said α-aluminum crystal grains, said second crystal grains are distributed along a crystal grain boundary of said α-aluminum crystal grains, and said first and second crystal grains of said intermetallic compounds are dispersed relative to each other so as to establish a non-continuous intermittent linkage between said crystal grains of said intermetallic compounds.

2. The high-strength high-toughness aluminum alloy in accordance with claim 1, wherein said first intermetallic compound contains Al and Zr, and said second intermetallic compound contains Al and Z, wherein Z is at least one metallic element selected from the group consisting of Y, La, Ce, Sm, Nd and misch metal.

3. The high-strength high-toughness aluminum alloy in accordance with claim 2, wherein said first intermetallic compound has an $L1_2$ or $D0_{23}$ type crystal structure.

4. The high-strength high-toughness aluminum alloy in accordance with claim 3, wherein said second crystal grains of said second intermetallic compound have a mean peripheral length in a range from 7 to 15 $\mu$m, said second crystal grains of said second intermetallic compound have a mean roundness in a range from 0.15 to 0.45, said second crystal grains of said second intermetallic compound have a mean acicular ratio in a range from 1 to 5, said second crystal grains of said second intermetallic compound have a standard deviation of orientation relative to the major axis direction of at least 40°, and the volume ratio of said second intermetallic compound in said alloy is 12 to 25 vol. %, on a ground section of said aluminum alloy, wherein said roundness is defined as 4×π×(sectional area of crystal grain of intermetallic compound)/(peripheral length of section of said crystal grain of intermetallic compound)$^2$, and said acicular ratio is defined as (absolute maximum length of section of crystal grain of intermetallic compound)/(absolute maximum width of said section of crystal grain of intermetallic compound perpendicular to said absolute maximum length).

5. The high-strength high-toughness aluminum alloy in accordance with claim 4, wherein said mean peripheral length is in a range from 10 μm to 13 μm, said mean roundness is in a range from 0.22 to 0.35, and said mean acicular ratio is in a range from 1.6 to 1.9.

6. The high-strength high-toughness aluminum alloy in accordance with claim 1, having a composition expressed as: $Al_aZr_bX_cZ_d$, where X is at least one metallic element selected from Ti, V, Cr, Mn, Fe, Co, Ni and Cu, Z is at least one metallic element selected from Y, La, Ce, Sm, Nd and misch metal, a is within the range of 90 to 97 atomic %, b is within the range of 0.5 to 4 atomic %, and c and d are expressed in atomic % within the two-variable range enclosed by point A at which c=0.1 and d=4, point B at which c=0.1 and d=1, point C at which c=2.5 and d=1, and point D at which c=1.5 and d=3.

7. The high-strength high-toughness aluminum alloy in accordance with claim 6, wherein Z is at least one metallic element selected from among Ce and misch metal.

8. The method of preparing the high-strength high-toughness aluminum alloy in accordance with claim 6, wherein a is in a range from 93 at. % to 96 at. %, b is in a range from 2 at. % to 4 at. %, and X includes at least two different metallic elements selected from Ti, V, Cr, Mn, Fe, Co, Ni and Cu.

9. A method of preparing the high-strength high-toughness aluminum alloy in accordance with claim 1, comprising the following steps:

providing a rapidly solidified aluminum alloy starting material having a cellular diploid structure comprising an α-aluminum crystal phase including a crystal nucleus having an intermetallic compound containing Al, and an intermetallic compound phase that contains Al and is different from said crystal nucleus, wherein said intermetallic compound phase encloses said α-aluminum crystal phase; and heat treating said starting material to a temperature of at least 593K at a temperature rising rate of at least 1.5K/sec.

10. The method of preparing the high-strength high-toughness aluminum alloy in accordance with claim 9, wherein said providing step comprises preparing said rapidly solidified aluminum alloy starting material by a rapid solidification of a starting aluminum alloy, and wherein said rapid solidification comprises a gas atomizing rapid solidification process or a liquid atomizing rapid solidification process, and further comprising hot plastic working after said heat treatment.

11. The method of preparing the high-strength high-toughness aluminum alloy in accordance with claim 10, wherein said hot plastic working is powder forging.

12. The method of preparing the high-strength high-toughness aluminum alloy in accordance with claim 10, wherein said rapid solidification is carried out at a cooling rate in a range from $10^3$ to $10^5$K/sec.

13. The method of preparing the high-strength high-toughness aluminum alloy in accordance with claim 9, wherein said intermetallic compound phase is continuously interconnected along a grain boundary of said α-aluminum crystal phase in said starting material, and said intermetallic compound phase becomes discontinuous and intermittently distributed along said grain boundary due to said heat treating.

* * * * *

UNITED STATES PATENT AND TRADEMARK OFFICE
CERTIFICATE OF CORRECTION

PATENT NO. : 6,149,737

DATED : November 21, 2000

INVENTOR(S) : HATTORI et al.

It is certified that error appears in the above-identified patent and that said Letters Patent is hereby corrected as shown below:

| | | |
|---|---|---|
| Col. 3, | line 22, | **(actual line count)**, after "been", insert --separate--; |
| | line 37, | after "a", insert --level that loosely corresponds inversely to the proportion of the brittle material grains, i.e. the toughness is generally reduced in accordance with an--; |
| Col. 4, | line 65, | after "metal)), insert --The first intermetallic compound existing in the α-aluminum crystal grains thus contains Al and Zr, whereby the heat resistance can be improved due to the fact that diffusion of Zr in the aluminum matrix is slow. Due to the fact that the second intermetallic compound distributed along the α-aluminum crystal grain boundary contains Al and Z (Z is at least one metallic element selected from the group consisting of Y, La, Ce, Sm, Nd and MM (misch metal)),--; |
| Col. 5, | line 5, | after "crystal", replace "lattic" by --lattice--; |
| | line 38, | after "length", replace "a 2and" by --a2 and--; |
| | line 67, | after "as", insert --shown in Fig.--; |

UNITED STATES PATENT AND TRADEMARK OFFICE
CERTIFICATE OF CORRECTION

PATENT NO. : 6,149,737

DATED : November 21, 2000

INVENTOR(S) : HATTORI et al.

It is certified that error appears in the above-identified patent and that said Letters Patent is hereby corrected as shown below:

Col. 7, line 42, replace the line to read: --DETAILED DESCRIPTION OF THE BEST--;

Table 2, Col. 2, Example 4, after "Zr-0.5", replace "Ti-0.5" by --Ti-1.5--;

Col. 8, line 7, after "end", insert --,--;

Table 2-continued, Col. 2, Example 19, after "Al-bal", replace "Zr-4" by --Zr-2--;
Table 3, Example 31, after "Ti-1", delete "V-0.5" ;
Table 3, Example 32, after "Ti-1", replace "V-0.5 Mm2" by --Ce-2-- ;
Table 3, Example 33, after "Ti-0.5", delete "V-0.5" ;
Table 3, Example 34, after "Ti-1.5", delete "V-0.5" ;
Table 3, Example 36, after "Cr-0.5", delete "V-0.5" ;
Table 3, Example 43, after "Zr-2", replace "Ti-1" by --Ti-4--;

Signed and Sealed this

First Day of May, 2001

*Attest:*

Nicholas P. Godici

NICHOLAS P. GODICI

*Attesting Officer*

*Acting Director of the United States Patent and Trademark Office*